US005520318A

United States Patent [19]

Sloop

[11] Patent Number: 5,520,318

[45] Date of Patent: May 28, 1996

[54] PICTURE HANGING APPARATUS

[76] Inventor: Conrad B. Sloop, 21 Sandy La., Pittsford, N.Y. 14534

[21] Appl. No.: 178,744

[22] Filed: Jan. 7, 1994

[51] Int. Cl.[6] ..... B25C 1/02

[52] U.S. Cl. ..... 227/32; 227/147; 227/156

[58] Field of Search ..... 227/31, 32, 147, 227/156; 29/275, 276

[56] References Cited

U.S. PATENT DOCUMENTS

| | | | |
|---|---|---|---|
| 3,166,757 | 1/1965 | Downs . | |
| 3,530,591 | 9/1970 | Moffitt . | |
| 3,599,686 | 8/1971 | Peebles . | |
| 3,883,064 | 5/1975 | Hilgers | 227/147 |
| 4,220,309 | 9/1980 | Eisen . | |
| 4,241,510 | 12/1980 | Radecki . | |
| 4,249,297 | 2/1981 | Waters . | |
| 4,455,756 | 6/1984 | Greene . | |
| 4,461,418 | 7/1984 | Schaefer | 227/147 |
| 4,559,690 | 12/1986 | Asmus . | |
| 4,804,161 | 2/1989 | Wallo . | |
| 4,860,937 | 8/1989 | Arnold | 227/147 |
| 4,874,123 | 10/1989 | Mercer, II et al. | 227/147 |
| 4,893,776 | 1/1990 | Floyd . | |
| 5,103,574 | 4/1992 | Levy . | |
| 5,180,135 | 1/1993 | Hindall . | |

*Primary Examiner*—Rinaldi I. Rada
*Assistant Examiner*—Allan M. Schrock
*Attorney, Agent, or Firm*—Freilich Hornbaker Rosen

[57] ABSTRACT

A picture hanging apparatus is provided, which facilitate the hanging of a picture on a wall. The apparatus includes a tool with a frame having a forward or inner part that lies in front of a picture to be hung and which holds a hook device, and an outer part which includes a base extending rearwardly from the top of the inner part and a handle extending downwardly from the rear of the base. A driving mechanism which is movably mounted on the frame, has a drive end lying at the inner part of the frame and movable along a driveline to drive a fastener into the wall, the mechanism also including an actuator end lying at the frame outer part and being operable to forcefully move the drive end along the driveline. One drive mechanism includes a strike member slidably mounted on the frame to move parallel to the driveline, with the strike member having an outer end forming the actuator and designed to be operated by hitting it with a hammer.

5 Claims, 2 Drawing Sheets

FIG. 4
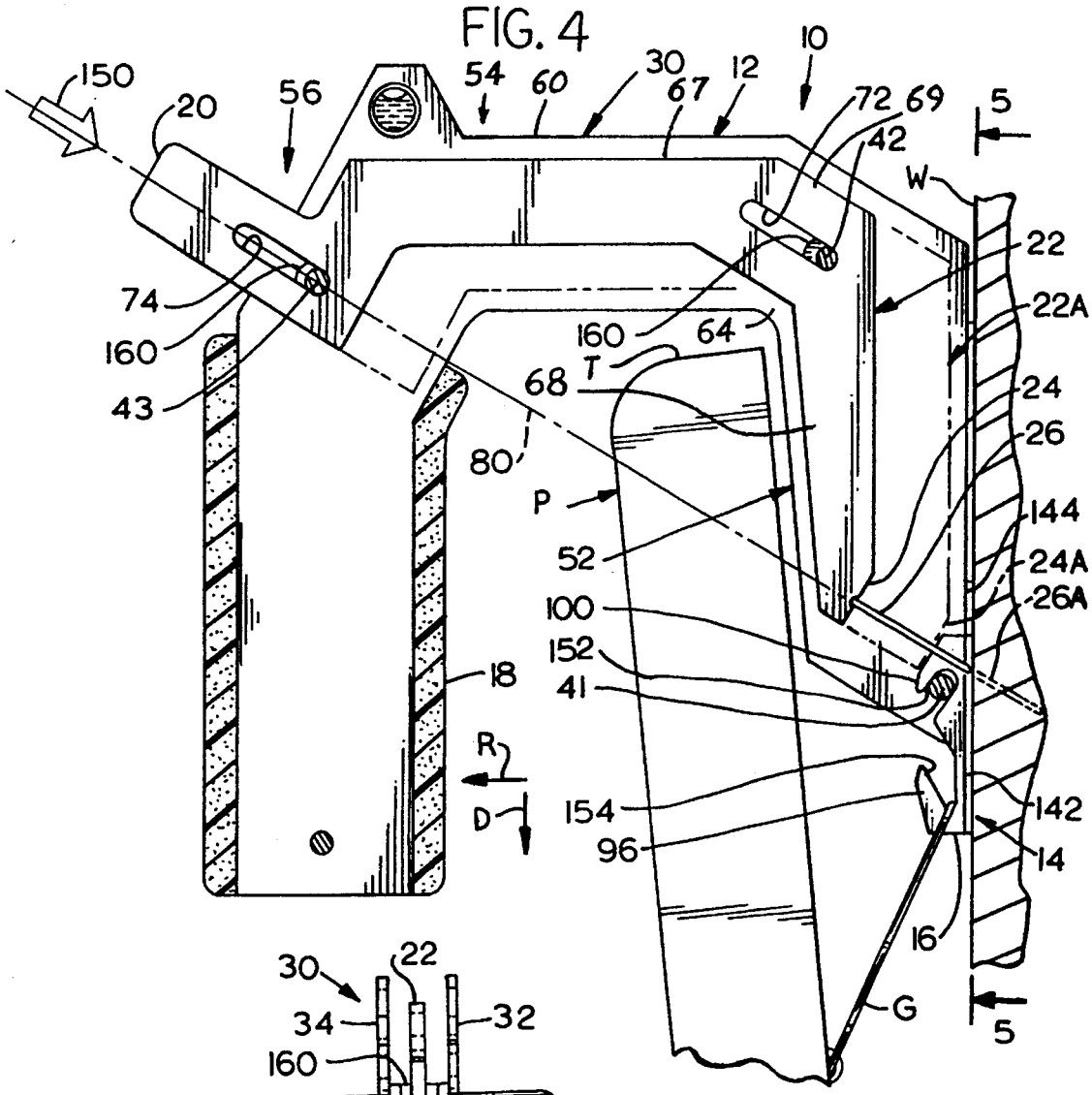
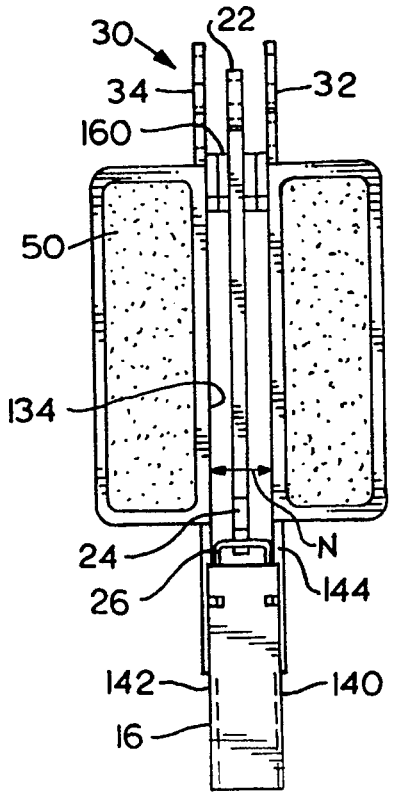
FIG. 5

PICTURE HANGING APPARATUS

BACKGROUND OF THE INVENTION

The hanging of a picture generally involves a person using his hands to support a picture on a wall to check for the desired picture position, and placing pencil marks on the wall to record the desired position. Then a hook position is estimated, at which a hook can be mounted which will support the picture wire so that the picture will lie at the desired picture position. Next, a hook device, comprising a hook and a push fastener such as a nail or staple, is mounted on the wall as by hammering the fastener into the wall. Finally, the picture is placed near the wall and manipulated so the picture wire moves down into a hook part of the hook device. These several steps can be time consuming for amateurs, especially when a large number of pictures are to be hung, as when a family moves to a new home. Also, the pictures do not always lie at the desired position due to difficulty in estimating the effect of picture wire bending.

A variety of devices have been proposed to aid person's in placing marks on a wall to indicate where the hook must be fastened. For example, U.S. Pat. No. 4,893,776 describes a device with a hook for supporting a picture through the picture wire, and which has a marking tip for marking the wall, or a pin or tack for creating a small hole to mark the wall. While such devices help, they still require lifting the picture to the desired position, operating a marking device, removing the picture, hammering in a hook device, and manipulating the picture so the picture wire will move down into the hook. A picture hanging tool which required only a single positioning of the picture to hang it, would be useful, especially where a large number of pictures are to be hung.

SUMMARY OF THE INVENTION

In accordance with one embodiment of the present invention, a picture hanging apparatus and method are provided for hanging a picture on a wall in a simple manner. The apparatus includes a frame with an inner part constructed to lie between a wall and an upper portion of a picture, and to hold a hook device. The frame also includes an outer part extending from the far end, such as the top, of the inner part to lie beyond the picture. A driving mechanism which is movably mounted on the frame, includes a drive end lying at the inner part and movable substantially along a predetermined straight driveline to drive a fastener into the wall. The driving mechanism also includes an actuator end lying at the outer part of the frame and coupled to the drive end, with the actuator being operable to forcefully move the drive end along the driveline.

In one picture hanging apparatus, the driving mechanism includes a strike member slidably mounted on the frame to move parallel to the driveline, with the strike member having an outer end designed to be hit by a hammer. In another picture hanging tool, the driving mechanism includes an outer lever that is pivotally mounted on the frame and which is coupled to a drive element that is mounted on the frame so its drive end moves along the driveline. The lever can be directly coupled to the drive element, or can be coupled through a ratchet mechanism.

The hook device includes a hook member with a lower hook part for receiving a picture wire and with an upper hook part which can hook onto a bar on the tool. The hook member has an inclined opening for passing a fastener to hang the hook member on a wall. Where the push fastener is a staple, the hook member opening is formed by a pair of elongated grooves at its opposite sides which receive opposite legs of the staple, with the legs of the staple being slightly converging to initially retain itself in the grooves.

The novel features of the invention are set forth with particularity in the appended claims. The invention will be best understood from the following description when read in conjunction with the accompanying drawings.

BRIEF DESCRIPTION OF THE DRAWINGS

FIG. 4 is a sectional side view of the apparatus of FIG. 2, showing it used to mount a picture.

FIG. 5 is a view taken on line 5—5 of FIG. 4.

DESCRIPTION OF THE PREFERRED EMBODIMENTS

Figure 1:
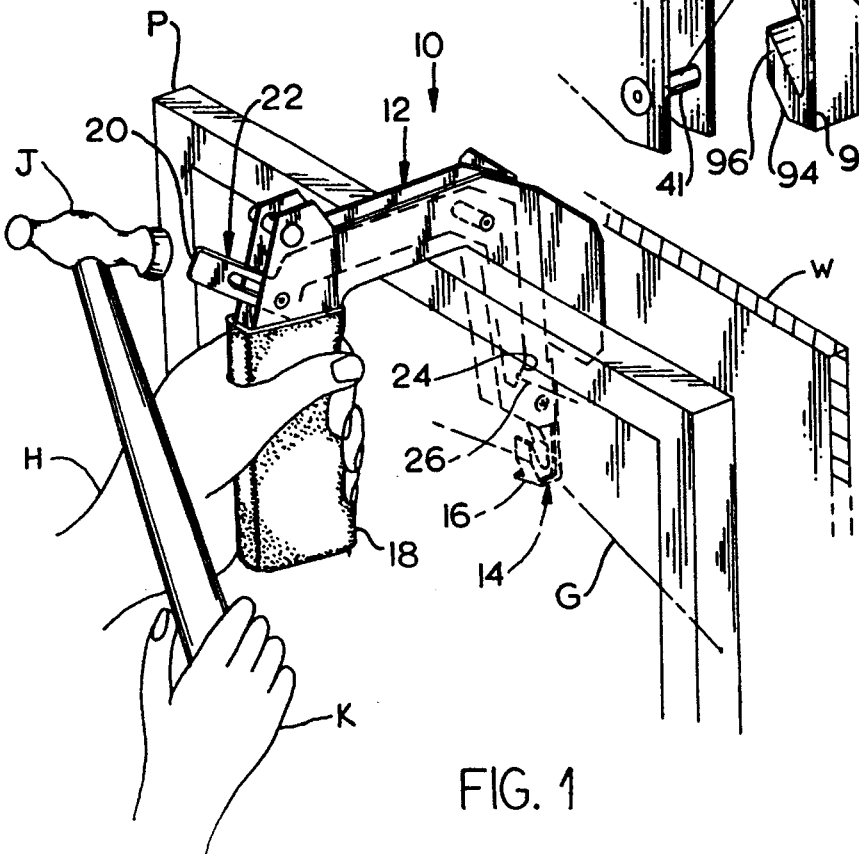
FIG. 1 is an isometric view of a picture hanging apparatus of the present invention, showing the manner in which it holds a picture and the manner in which the apparatus is operated.

FIG. 1 illustrates a picture hanging apparatus 10 which includes a tool 12 and a hook device 14 that is releasably mounted on the tool. The apparatus is used to hang a picture P on a wall W. The person first hooks the picture wire G onto a hook member 16 of the hook device which is carried by the tool 12, and holds a handle 18 of the tool with his/her hand H. The person holds a hammer J with his other hand K and strikes an actuator end 20 of a strike member 22. This causes a drive end 24 of the strike member to push a push fastener 26 of the hook device, into the wall. The drive end 24 lies between the wall and the picture, but below the top T of the picture. The person then manipulates the handle 18 of the tool to release it from the hook member 16, and leaves the picture hung on the wall through the hook member 16 and fastener 26.

Figure 2:
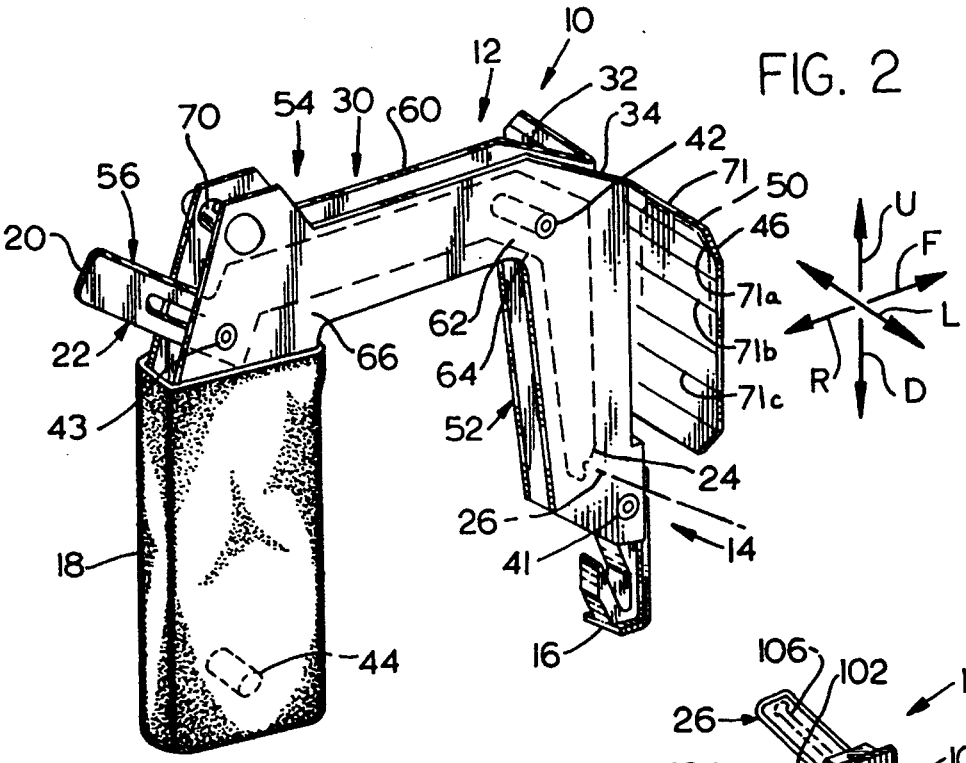
FIG. 2 is an isometric view of the apparatus of FIG. 1.

As shown in FIG. 2, the tool 12 includes a frame 30 that comprises a pair of rigid sheet metal members 32, 34 which are spaced apart by a group of rods 41–44. (It should be noted that the frame can be made of molded plastic, etc.) Forward ends of the sheet metal are bent to extend in lateral directions L to form flanges 46 that carry rubber friction pads 50 to resist slipping of the tool on the wall. The handle 18 is formed by a wrapping of foam material about the sheet metal members. The frame includes an inner part 52 which is designed to lie forward, in the direction F of a picture, and against a wall. The frame also includes an outer part 54, which is designed to lie above and/or rearward of the picture, where the tool can be handled and a drive mechanism 56 can be operated. The outer part includes a horizontal base 60 which has a forward end 62 extending from the upper or far end 64 of the inner part. The horizontal base has an outer or rearward end 66, and the handle 18 extends downwardly therefrom. A bubble level device 70 lies on the outer part, where it can be readily seen, and extends laterally to position the top of the picture horizontally on the wall rather than tilted, by checking that the picture top is parallel to the line 71 when the level device is in a level orientation. A line 71 is formed by the tops of the flanges, and is horizontal when the bubble level device is horizontal. The line 71, which is preferably at least three inches long, can be used to properly orient the picture top on the tool. Additional lines such as 71*a*, 71*b* and 71*c* are formed at different heights, so there will be a horizontal line just above the top of the picture, regardless of how loose the picture wire is.

As shown in FIG. 4, the striker member 22 of the drive mechanism is bent so it is angled from a straight line, in that it has a mid portion 67 that lies in the frame base 60 and that extends substantially horizontally, and in that the striker member has a downward portion 68 that extends down from a front end 69 of the striker member mid portion. The striker member downward portion 68 lies within the frame inner portion 52. The striker member 22 is slidably mounted on the frame, by slots 72, 74 of the strike member receiving rods 42, 43. The slots 72, 74 each extends parallel to a driveline 80. The driveline 80 extends at a forward-downward incline; that is, locations along the driveline that lie progressively more forward also lie progressively lower or more downward, when the inner part 52 extends substantially vertically. As a result, when the actuator end 20 of the strike member is hit generally along the driveline 80, the strike member moves in that direction and causes the drive end 24 of the strike member to move along the straight driveline 80. This causes the drive end 24 to push the staple 26 forcefully along the driveline 80 into the wall. The staple moves a distance of at least one-quarter inch, or 6 mm, (which is a plurality of times greater than the thickness of each staple leg) along the driveline to securely anchor it in the wall. Preferably, the staple moves at least ⅝ths inch for insertion through the full thickness of even a thin wallboard of one-quarter inch thickness. It can be seen that the tool 12 can be removed from the wall-mounted hook device 14 by merely moving the lower end of the tool inner part 52 in a downward and rearward direction.

Figure 3:
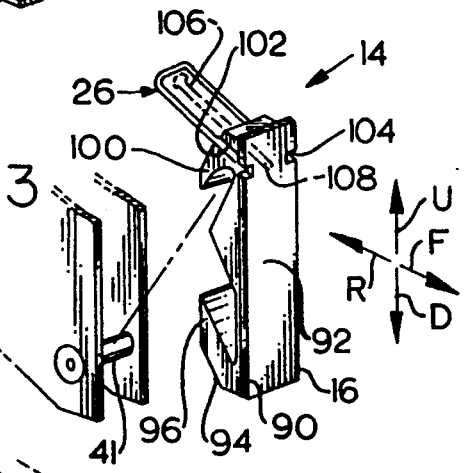
FIG. 3 is an isometric view of the hook device of the apparatus of FIG. 2, and showing a portion of the tool on which it is mounted.

FIG. 3 shows the hook device 14 in a ready position, with the staple push fastener 26 not yet driven forward. The hook or hook member 16 has a front portion 90 with a front surface 92 for lying facewise against a wall, and has a rear portion 94. The rear portion has a forwardly-downwardly inclined lower hook part 96 for holding a picture wire. The rear portion also forms a forwardly-upwardly inclined upper hook part 100 for releasable mounting of the hook member on a hook device holder formed by the first rod 41 of the picture hanging tool. The hook member also has forwardly-downwardly inclined openings in the form of grooves 102, 104 for receiving the staple. It may be noted that it is possible to use a nail type push fastener indicated at 106, instead of a staple, and to provide a single passage or opening 108 to slidably guide such a nail.

To hang a picture, a person pulls the striker member 22 of FIG. 4 largely rearwardly, opposite to the direction of strike arrow 150. The staple 26 is placed in the hook member 16 and the hook member is mounted on the tool, by reception of its largely downwardly opening upper hook slot 152 of its upper hook 100 on the first tool rod 41. The picture wire G is then hooked into a largely upwardly opening lower hook slot 154 of the lower hook 96. A person then grasps the tool handle 18 and lifts it and the hook and picture P to a desired position against the wall W. The person then takes a hammer and uses it to strike the actuator end 20 of the strike member. The strike member then moves from the position 22 to the position 22A, with the drive end 24 moving to the position 24A to drive the staple 26 into the wall to the position 26A. The person then moves the tool handle to move the inner part 52 of the tool downwardly and rearwardly so the first rod 41 withdraws from the hook slot 152. The person then raises the tool above the picture P and allows all of the picture to hang closely against the wall. It may need noted that FIG. 5 shows washers 160 that accurately position the strike member 22 laterally between the sheet metal members 32, 34 of the frame.

Although applicant has shown a picture hanging tool which mounts only a single hook on a wall, the invention can be altered to hold two hooks which together hold a single picture wire, and to drive staples or other fasteners into the wall to hold corresponding hook members to the wall. A common large stapler mechanism can be used, in which a lever pulls back and releases a spring loaded hammer. It is possible for the driving mechanism to be powered by an electric motor, especially in the case of a device that must drive two fasteners into the wall. It is possible to use the picture hanging apparatus (with a modified hook device) to support a picture which has a toothed rack instead of a picture wire. Although applicant prefers to have the inner part of the frame which lies behind the picture, extend downwardly from the outer part, it is possible for the inner part to extend sidewardly and/or upwardly from an outer part where a handle and the actuating part of a drive mechanism are located. In other words, the outer part of the frame (where the handle and actuating part of the drive mechanism lies) need only lie beyond the picture, that is, above, below, or at a side of the picture and/or rearward of the picture. The inner part (where the drive end of the mechanism lies) lies between the picture and the wall, and a far end of the inner part which lies beyond the picture, connects to the outer part.

Thus, the invention provides a picture hanging apparatus which facilitates the hanging of pictures on a wall. The apparatus includes a tool which supports a hook device that can mount on the tool. The tool has a frame with an inner part that is designed to lie between a wall and picture, and includes an outer part designed to lie above and/or rearward of the picture and to contain a handle and the operating part of a fastener driving mechanism. In one tool, the driving mechanism includes a striking member which is slidably mounted on the frame to slide in a drive direction, with a forward end forming a drive end for engaging the fastener and with a rear end forming an actuator end of the Although particular embodiments of the invention have been described and illustrated herein, it is recognized that modifications and variations may readily occur to those skilled in the art, and consequently, it is intended that the claims be interpreted to cover such modifications and equivalents.

I claim:

1. A picture hanging apparatus for hanging a picture on a rearwardly-facing wall by driving at least a part of a hook device at least partially forwardly into the wall, comprising:

a tool frame having an inner part constructed to lie adjacent to and rearward of the wall and directly in front of the picture when in a use position, said inner part having a releasable hook device holder that is constructed to support a hook device that lies directly forward of the picture while the hook device supports the picture and which is releasable from the hook device, and said inner part having a far end lying beyond a position in front of said picture, said frame having an outer part extending from said far end of said inner part so said outer part lies forward of said picture;

a drive mechanism movably mounted on said frame, said drive mechanism having a drive end lying directly forward of the picture and movable substantially along a predetermined driveline relative to said frame, said driveline extending with a forward directional component and passing through the picture, to drive the hook device into the wall, said drive mechanism having an actuator end lying adjacent to said frame outer part and coupled to said drive end, and said actuator end being operable to forcefully move said drive end along said driveline to push said hook device into a wall, when said frame inner part lies adjacent to the wall and said driveline extends through the picture;

said drive mechanism extending in a path that is angled from a straight line so a line connecting said drive end and said actuator end passes directly through the picture, and yet without any part of said drive mechanism actually passing directly through the picture;

said drive mechanism includes a strike member slidably mounted on said frame to move parallel to said driveline, said strike member having an outer end forming said actuator end and designed to be operated by hitting said outer end with a hammer device, said strike member having an inner end forming said drive end, and said strike member being bent to extend around the top of the picture.

2. A picture hanging tool for installing a hook on a wall to hang a picture on the wall, comprising:

a frame which, in a use position, has a largely horizontally extending base part having forward and rearward ends, a handle extending primarily downwardly from said rearward end, and an inner part extending primarily downwardly from said forward end and having a lower portion to lie between a picture and a wall;

a driving mechanism mounted on said frame and including a member having a drive end lying at said lower portion of said inner part, said drive end being confined to movement on said frame along substantially a straight driveline which extends at an incline, said member being forcefully movable substantially along said driveline to drive a fastener into the wall to hold a picture hook device on the wall;

said member being bent to extend around the top of the picture when in the use position, and having a strike end which projects from said frame outer part to enable said strike end to be hit by a hammer.

3. A picture hanging tool comprising:

a frame which, in a use position, has a largely horizontally-extending base with front and rear ends, a frame inner part extending down from said base front end, and a handle extending largely downwardly from said base rear end;

a drive mechanism mounted on said frame, including a striker member slidably mounted on said frame to slide along a driveline that extends in forward and downward directions, said member having a drive end lying substantially on said driveline below said base front end, an actuator end lying substantially rearward of said base rear end and substantially on said driveline, a mid portion lying above said driveline, and a downward portion that extends generally downwardly from a front end of said mid portion to said drive end.

4. A combination comprising a picture which has a top, a structure with a vertical wall having a rearwardly facing surface on which the picture is to be hung, and a picture hanging apparatus for hanging the picture on the wall by driving at least a part of a hook device at least partially forwardly into the wall; wherein said picture hanging apparatus includes:

a tool frame having an inner part lying adjacent to said wall and in front of said picture, said inner part having a releasable hook device holder that lies directly in front of said picture and that is constructed to support a hook device while the hook device supports the picture and which is releasable from the hook device, and said inner part having a far end lying beyond a position directly in front of said picture, said frame having an outer part extending from said far end of said inner part away from a position directly in front of said picture;

a drive mechanism movably mounted on said frame, said drive mechanism has a drive end lying directly forward of said picture and below said picture top, said drive end being movable substantially along a predetermined driveline relative to said frame, with said driveline extending directly through said picture, to drive a hook device into said wall, said drive mechanism having an actuator end mounted on said frame outer part and coupled to said drive end, said actuator end being operable to forcefully move said drive end largely forwardly along said driveline to push said hook device into said wall, but said drive mechanism deviates from a straight line and does not extend through said picture, all when said frame is in a use position.

5. The apparatus described in claim 4 wherein:

said inner part of said frame extends primarily vertically and said far end is uppermost, when said frame is in said use position, and said outer part of said frame includes a base extending largely horizontally and rearwardly from said far end of said inner part and having a rear end, and a handle extending largely downwardly from said rear end of said base, all when said frame is in a use position.

* * * * *